US011085666B2

(12) United States Patent
Garg et al.

(10) Patent No.: US 11,085,666 B2
(45) Date of Patent: Aug. 10, 2021

(54) COLLAPSIBLE ROOF TOP UNIT SYSTEMS AND METHODS

(71) Applicant: Johnson Controls Technology Company, Auburn Hills, MI (US)

(72) Inventors: Karan Garg, Pune (IN); Gurpreet Singh, Alwar (IN); Neelkanth S. Gupte, Katy, TX (US); Vinay Nanjappa, Bangalore (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 338 days.

(21) Appl. No.: 15/997,266

(22) Filed: Jun. 4, 2018

(65) Prior Publication Data

US 2019/0360719 A1 Nov. 28, 2019

Related U.S. Application Data

(60) Provisional application No. 62/675,038, filed on May 22, 2018.

(51) Int. Cl.

| | |
|---|---|
| ***F24F 13/20*** | (2006.01) |
| ***F24F 3/044*** | (2006.01) |
| ***F24F 13/28*** | (2006.01) |
| ***F24F 13/22*** | (2006.01) |

(52) U.S. Cl.

CPC ..... *F24F 13/20* (2013.01); *F24F 3/044* (2013.01); *F24F 13/222* (2013.01); *F24F 13/28* (2013.01); *F24F 2221/12* (2013.01); *F24F 2221/16* (2013.01)

(58) Field of Classification Search

CPC ..... F24F 13/20; F24F 13/222; F24F 13/28; F24F 3/044; F24F 2221/12; F24F 2221/36; F24F 2221/16; F25B 2500/01; F25B 2500/17

See application file for complete search history.

(56) References Cited

U.S. PATENT DOCUMENTS

| | | | | |
|---|---|---|---|---|
| 6,957,670 | B1 | 10/2005 | Kajino | |
| 8,534,092 | B2 * | 9/2013 | Lee | F24F 1/0057 62/428 |
| 8,935,929 | B1 | 1/2015 | Prater | |
| 9,572,288 | B2 | 2/2017 | Wilcox et al. | |
| 2011/0192188 | A1 | 8/2011 | Nickey et al. | |
| 2016/0238276 | A1 * | 8/2016 | Andrew | B01D 46/4263 |
| 2017/0089594 | A1 * | 3/2017 | Small, III | A47C 27/081 |
| 2017/0089613 | A1 * | 3/2017 | Wu | F25B 6/02 |

FOREIGN PATENT DOCUMENTS

| | | |
|---|---|---|
| CN | 104807154 | 7/2015 |
| JP | 2006132937 | 5/2006 |

* cited by examiner

*Primary Examiner* — Joseph F Trpisovsky
(74) *Attorney, Agent, or Firm* — Fletcher Yoder, P.C.

(57) ABSTRACT

A collapsible roof top unit (RTU) includes a plurality of heating, ventilation, and air conditioning (HVAC) components. The collapsible RTU also includes a frame disposed about the plurality of HVAC components. The frame is configured to transition between a full frame width configuration and a reduced frame width configuration. Additionally, the frame includes a plurality of retractable rails.

26 Claims, 13 Drawing Sheets

COLLAPSIBLE ROOF TOP UNIT SYSTEMS AND METHODS

CROSS REFERENCE TO RELATED APPLICATIONS

This application claims priority from and the benefit of U.S. Provisional Application Ser. No. 62/675,038, entitled "COLLAPSIBLE ROOF TOP UNIT SYSTEMS AND METHODS," filed May 22, 2018, which is hereby incorporated by reference.

BACKGROUND

The present disclosure relates generally to heating, ventilation, and air conditioning (HVAC) systems, and more particularly, to systems and methods for roof top units (RTUs) of the HVAC systems.

Residential, light commercial, commercial, and industrial systems are used to control temperatures and air quality in buildings. To condition a building, an HVAC system may circulate a refrigerant through a closed circuit between an evaporator where the refrigerant absorbs heat and a condenser where the refrigerant releases heat. The refrigerant flowing within the closed circuit is generally formulated to undergo phase changes within the normal operating temperatures and pressures of the HVAC system so that quantities of heat can be exchanged by virtue of the latent heat of vaporization of the refrigerant to provide conditioned air to the buildings.

In general, an HVAC system may include a RTU to house various components of the HVAC system, such as the condenser, the evaporator, a fan assembly, a blower, and so forth. As such, the RTU may be a large and heavy enclosure that is expensive to transport between facilities, such as a manufacturing facility and the building to be conditioned by the HVAC system. In certain instances, the RTU has a width that is larger than a width of a standard-sized transportation vehicle, such that the RTU is characterized as an oversized load that demands more expensive and time consuming travel processes compared to standard transportation loads. For example, transporting the RTU may entail acquiring an over-width permit, adhering to stringent safety regulations, longer shipping time, and/or higher shipping costs.

SUMMARY

In one embodiment of the present disclosure, a collapsible roof top unit (RTU) includes a plurality of heating, ventilation, and air conditioning (HVAC) components. The collapsible RTU also includes a frame disposed about the plurality of HVAC components. The frame is configured to transition between a full frame width configuration and a reduced frame width configuration. Additionally, the frame includes a plurality of retractable rails.

In another embodiment of the present disclosure, a collapsible roof top unit (RTU) for a heating and cooling system includes a condenser section configured to transition between a full condenser section width and a reduced condenser section width. The condenser section includes a first condenser coil and a second condenser coil. Additionally, the second condenser coil is rotatable, relative to the first condenser coil, between an angled operating position and a generally vertical non-operating position.

In a further embodiment of the present disclosure, a method of collapsing a collapsible roof top unit (RTU) includes rotating a fan assembly of the collapsible RTU from a horizontal operating position to a lifted position. The method includes rotating a condenser coil from an angled operating position to a generally vertical position. Moreover, the method includes collapsing a frame disposed about the fan assembly and the condenser coil from an expanded position having a full frame width to a collapsed position having a reduced frame width.

Other features and advantages of the present application will be apparent from the following, more detailed description of the embodiments, taken in conjunction with the accompanying drawings which illustrate, by way of example, the principles of the application.

DETAILED DESCRIPTION

The present disclosure is directed to a foldable or collapsible roof top unit (RTU) for heating, ventilation, and air conditioning (HVAC) systems. The collapsible RTU may be selectively reduced in width to enable the collapsible RTU to be transported on a standard-sized transportation vehicle, thus lowering costs and increasing shipping efficiency compared to transporting non-collapsing and large RTUs as oversized loads.

Thus, as described in more detail below, a condenser section having condensers and a fan assembly, an evaporator section, and other HVAC components of the collapsible RTU may be rotatable, slidable, and/or positioned such that a frame disposed around the HVAC components may be collapsed to reduce a width of the collapsible RTU for transportation on a standard-sized transportation vehicle. For example, condenser coils of the condensers may be rotated from outwardly-leaning positions to generally vertical positions, and horizontal top plates of a fan assembly of the collapsible RTU may be pivoted into lifted positions that enable the condenser section to be reduced in width. Moreover, in place of a traditional one-coil evaporator, the evaporator section of the collapsible RTU may include two evaporator coils that are longitudinally spaced and/or offset from one another along a direction defined by a length of the collapsible RTU. Additionally, the frame disposed around the HVAC components may be a telescoping or width-collapsible frame having base cross rails and top cross rails that selectively reduce in length. As such, after the condenser coils are moved to the vertical positions and the top plates of the fan assembly are pivoted to the lifted positions, a technician or a suitable actuator may apply force to collapse the frame of the collapsible RTU and reduce its width for transportation. Then, once at an installation location, the frame may be expanded and the HVAC components may be moved back into operating positions so that the collapsible RTU may operate to condition the building.

Figure 1:
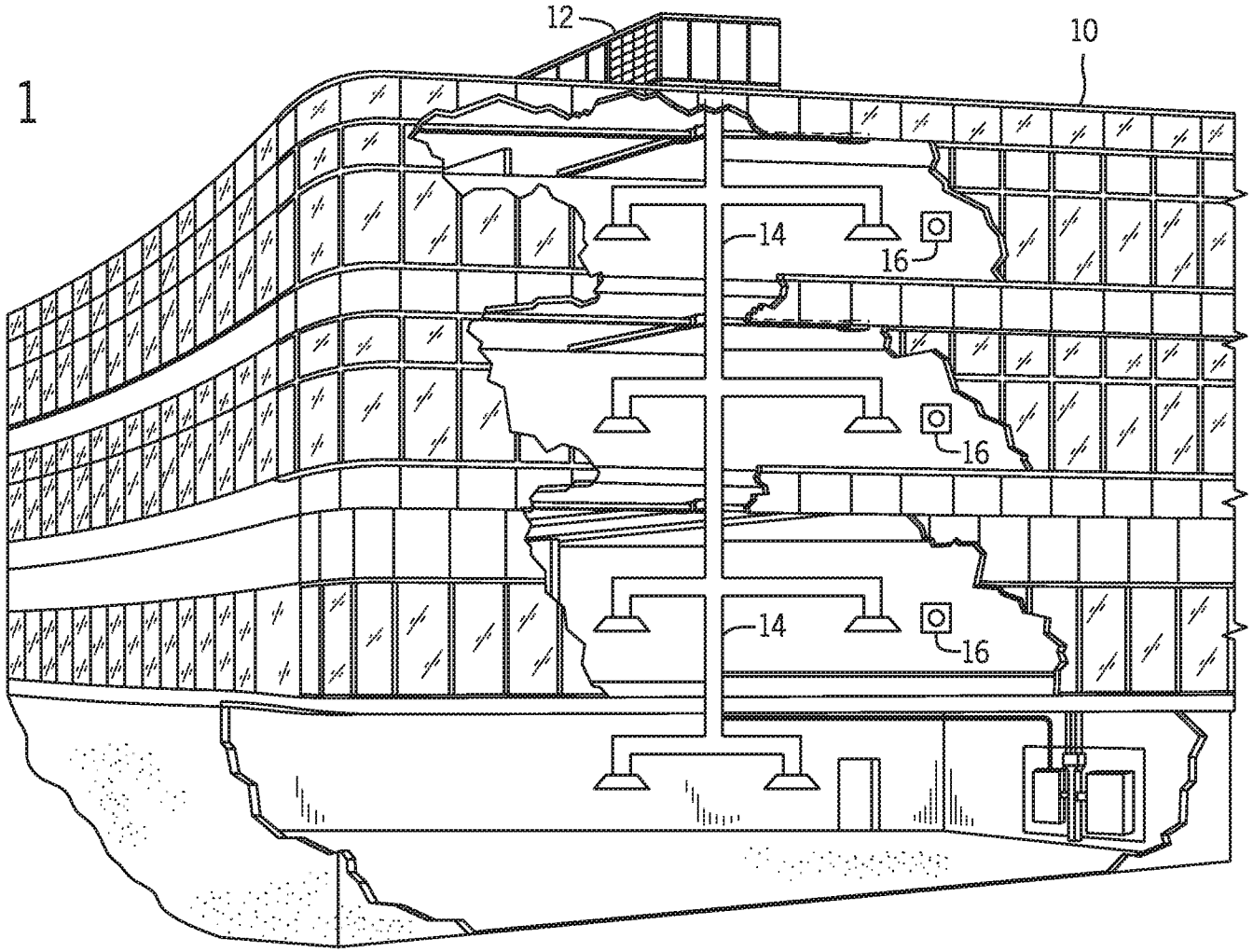
FIG. 1 is an illustration of an embodiment of a commercial or industrial HVAC system, in accordance with an aspect of the present disclosure.

Turning now to the drawings, FIG. 1 illustrates a heating, ventilation, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
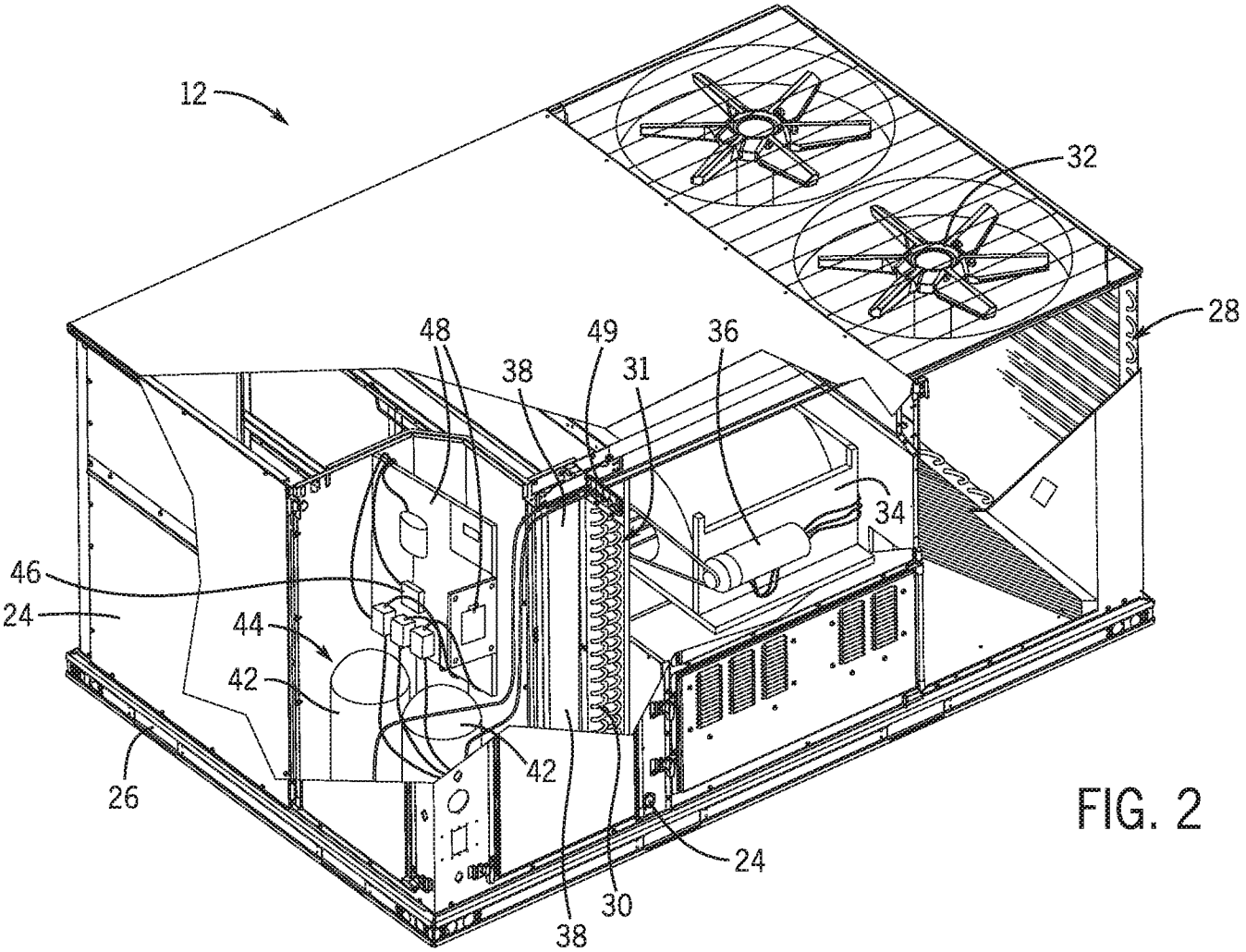
FIG. 2 is an illustration of an embodiment of a packaged unit of the HVAC system, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
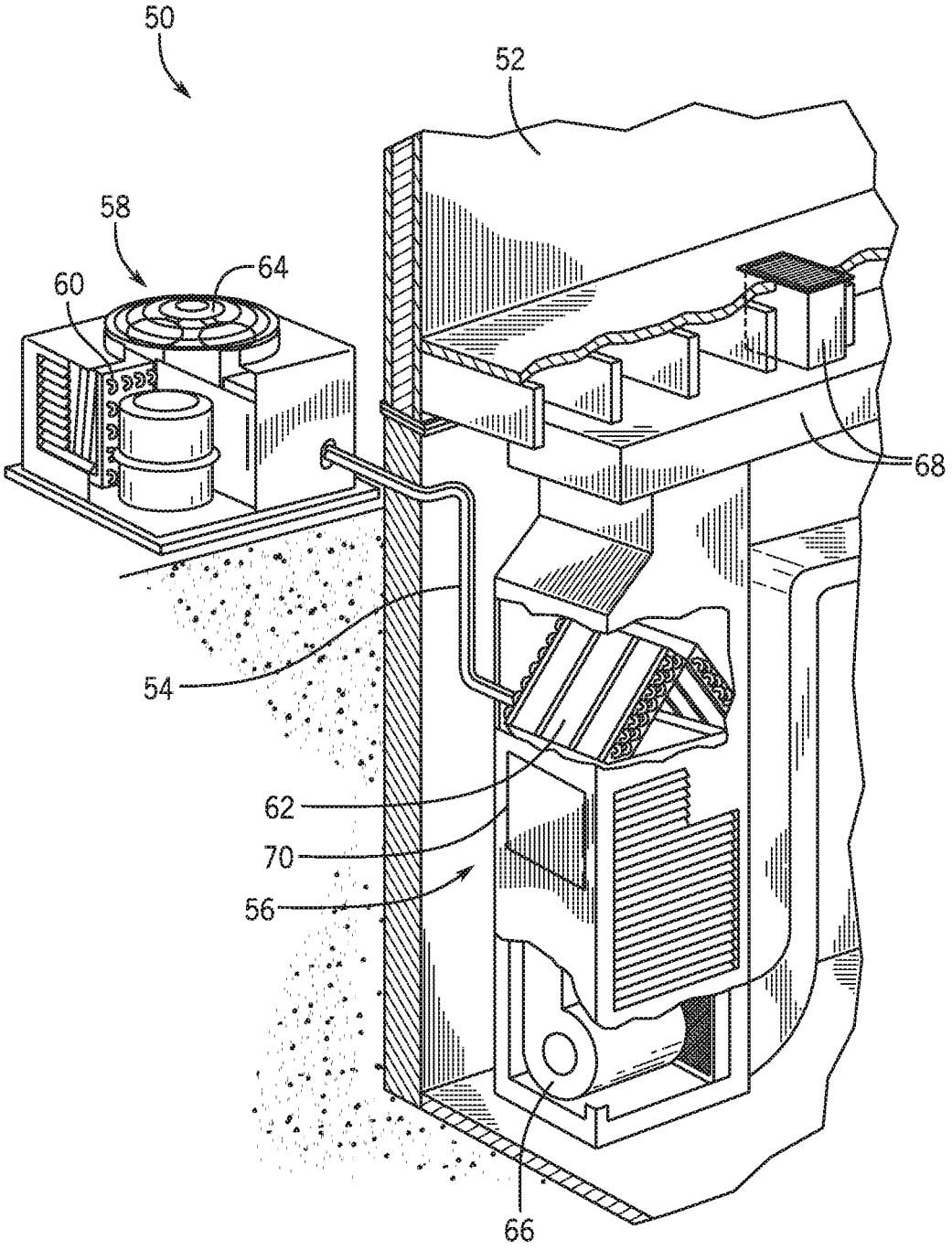
FIG. 3 is an illustration of an embodiment of a split system of the HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger that is separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
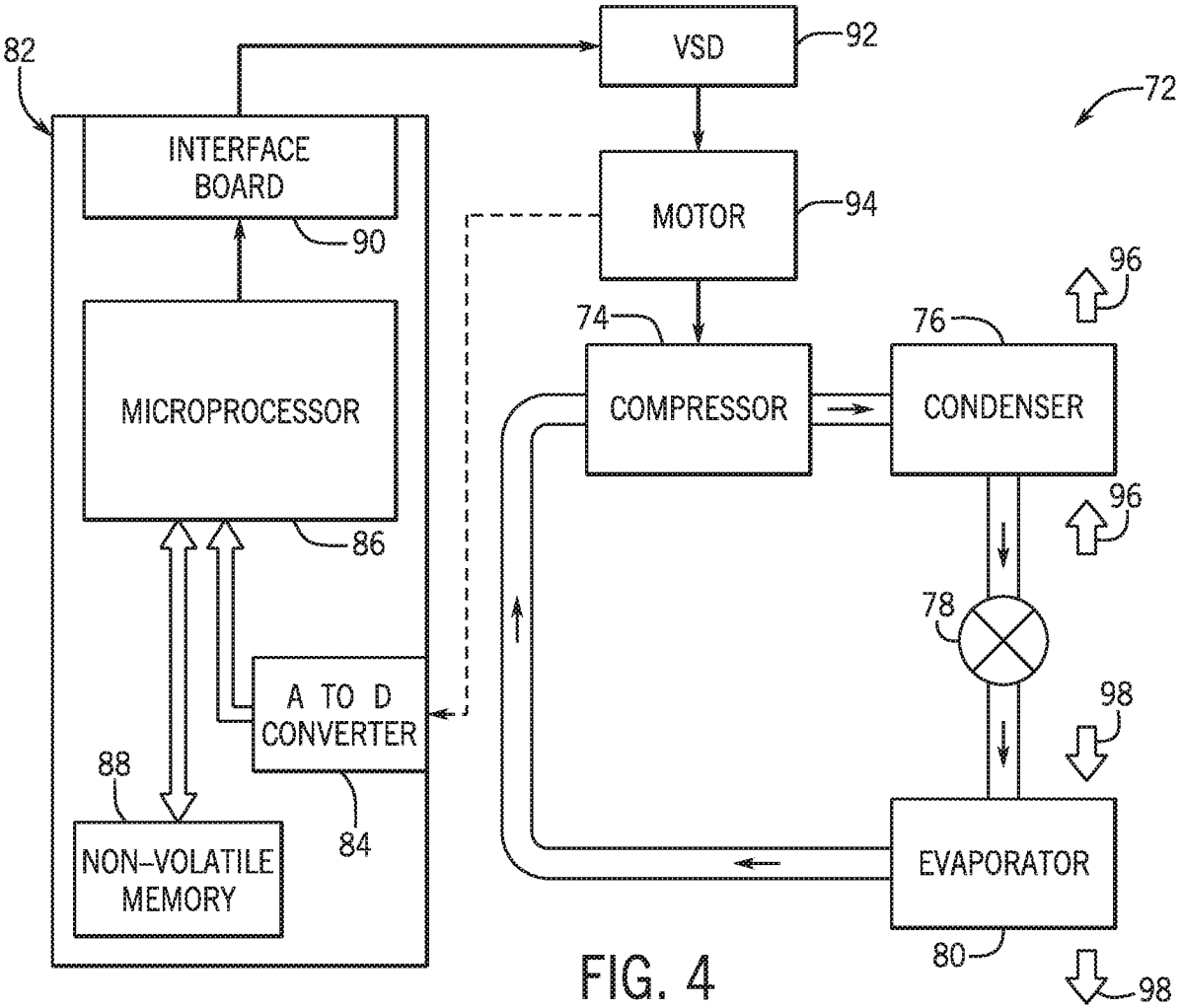
FIG. 4 is a schematic diagram of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to a collapsible RTU system for enabling efficient transportation of the HVAC unit 12, the residential heating and cooling system 50, the vapor compression system 72, and/or any other suitable HVAC system, which are collectively referred to hereinafter as a collapsible RTU. Although described hereinafter with reference to the collapsible RTU, it is to be understood that the collapsible RTU system or components therein may also be used or adapted to collapse or reduce in size any enclosure of any suitable HVAC system, including enclosures of split or residential HVAC systems. In some embodiments, the collapsible RTU system may be used to efficiently transport the collapsible RTU from a manufacturing facility to the building 10 where the collapsible RTU is to be installed and operated. By selectively reducing a width of the collapsible RTU, the collapsible RTU may be transported on standard-size transportation trucks or other transportation equipment, such as trains, ships, planes, and so forth, thus reducing costs and transportation time compared to oversize loads.

Figure 5:
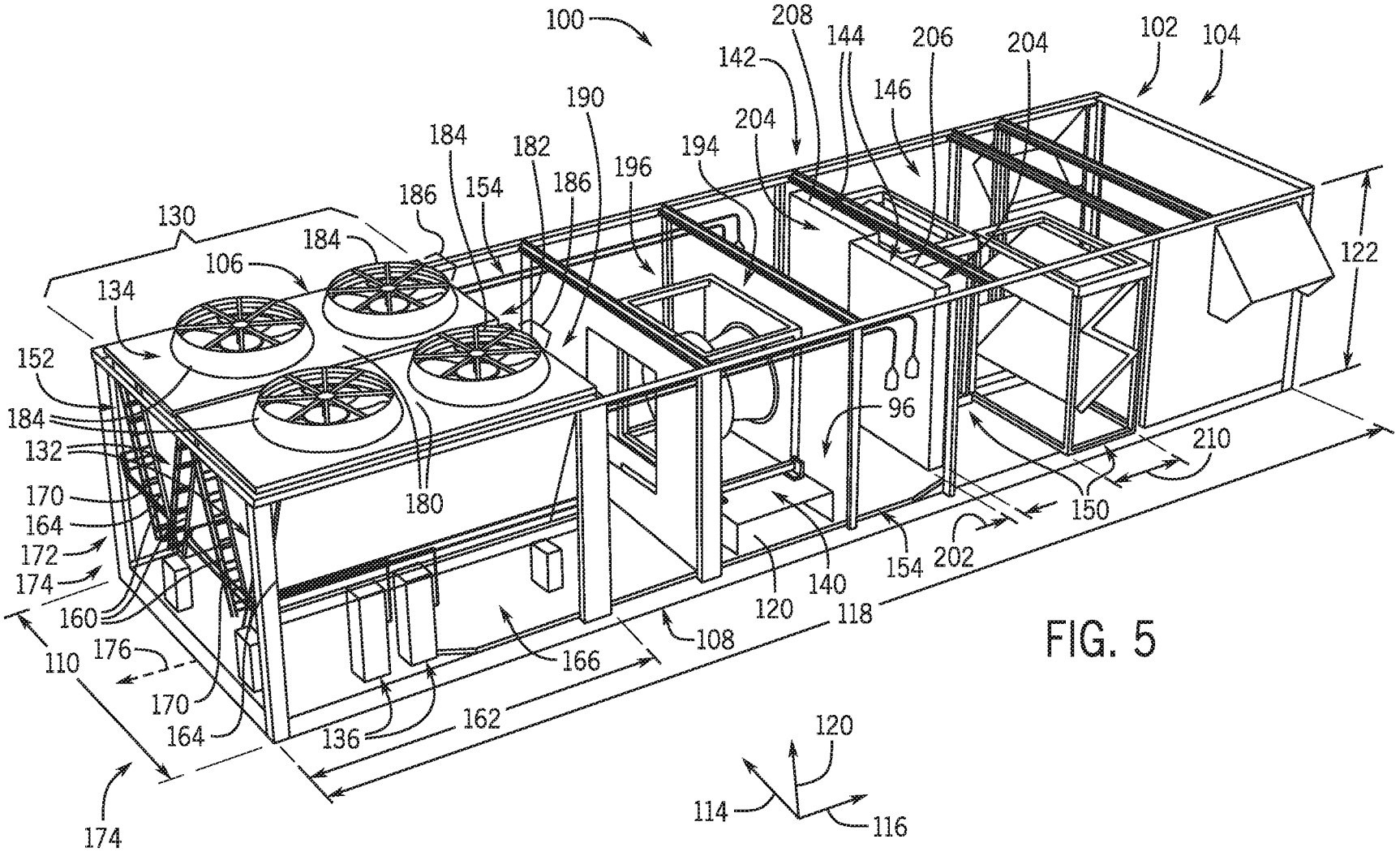
FIG. 5 is a perspective cutaway view of an embodiment of a collapsible RTU system in an expanded position, in accordance with an aspect of the present disclosure.

For instance, FIG. 5 is a perspective cutaway view of an embodiment of a collapsible RTU system 100 including a collapsible RTU 102 in an expanded position 104. As recognized herein, certain HVAC components 106 may be adapted to enable a frame 108 or collapsible frame of the collapsible RTU 102 to reversibly move or transition from an expanded width 110 or full frame width associated with the expanded position 104 to a collapsed or reduced width associated with a collapsed position that enables the collapsible RTU 102 to be transported on standard-size transportation vehicles. As referred to herein, a y-axis 114 is defined along the expanded width 110 of the frame 108, an x-axis 116 is defined along a frame length 118 of the frame 108, and a z-axis 120 is defined along a frame height 122 of the frame 108.

Walls or panels to enclose the frame 108 are partially omitted in the present embodiment to enable visualization of the HVAC components 106 disposed within the collapsible RTU 102. As illustrated, the HVAC components 106 of the collapsible RTU 102 include a condenser section 130 having condensers 132 and a fan assembly 134, compressors 136, a blower 140, an evaporator assembly 142 having evaporator coils 144, an air filter assembly 146 having filter elements 150, flexible tubing 152, and rigid tubing 154. Each HVAC component 106 may be collapsible, slidable, formed, and/or positioned within the collapsible RTU 102 such that the frame 108 may be moved from the expanded position 104 to the collapsed position with all or a portion of the HVAC components 106 within the frame 108. In general, the collapsible RTU 102 may be manufactured in the expanded position 104, moved into the collapsed position, transported to the building 10, and then moved back into the expanded position 104, as described herein and illustrated in further figures below. However, the collapsible RTU 102 of the collapsible RTU system 100 may be collapsed and/or expanded in any other suitable sequence.

Looking first to the condensers 132 within the condenser section 130, the condensers 132 include condenser coils 160 that have a condenser coil length 162 oriented or extending along the x-axis 116, such that the condenser coils 160 extend in a common longitudinal direction along the x-axis 116. The present embodiment includes two condensers 132: one for each of two refrigeration circuits of the collapsible RTU 102. However, the condensers 132 may be part of a same refrigeration circuit in other embodiments, or more than two refrigeration circuits and corresponding numbers of condensers 132 may be included in other embodiments. Moreover, each condenser 132 includes a V-shape configuration, in which two condenser coils 160 are aligned to have a V-shape in the expanded position when viewed along the x-axis 116. The condenser coils 160 of each condenser 132 may therefore include an outer condenser coil 164 closer to wall portions 166 of the frame 108 than an inner condenser coil 170 of each condenser 132.

To facilitate collapsing of the collapsible RTU 102, the inner condenser coils 170 of the collapsible RTU system 100 are pivotable from an operating position 172 or angled operating position to a generally vertical position in which the inner condenser coils 170 generally extend upward along the z-axis 120. That is, a technician may move the inner condenser coils 170 to the generally vertical position and lock the inner condenser coils 170 in place, such that an open space is defined between the inner condenser coils 170 of adjacent V-coils. Thus, when the frame 108 is collapsed, edge portions 174 of the frame 108 move inward toward a longitudinal centerline 176 of the collapsible RTU 102 extending along the x-axis 116, and the inner condenser coils 170 move closer together in the vertical position without interfering with one another. To facilitate the movement, all or a portion of conduits or tubing connected to the condenser coils 160 may be made from the flexible tubing 152, such as that made from braided metal, plastic tubes, and so forth. In contrast to the illustrated orientation of the condenser coils 160, traditional condenser coils may be oriented such that their lengths extend perpendicularly to a frame length of a traditional RTU. As such, the traditional condenser coils block or prevent the traditional RTU from efficiently reducing a width of the traditional RTU. While the condenser coils 160 are illustrated as two V-coils, it is to be understood that other shapes or quantities of condenser coils may also be used within the collapsible RTU.

To further facilitate collapsing of the frame 108, the fan assembly 134 of the condenser section 130 may include a cover plate or top plate 180 coupled to the frame 108 above each condenser 132. As such, the top plates 180 may be coupled together by a longitudinal hinge 182 or another suitable pivotable element extending between the top plates 180 along the x-axis 116. Additionally, two or another suitable quantity of fans may be supported by and retained within each top plate 180. In some embodiments, the technician may accordingly lift an outer edge portion 186 of each top plate 180 such that the fan assembly 134 is in a lifted position or folded position forming a V-shape having a decreased width and an increased height compared to a horizontal position 190 or operating position of the fan assembly 134 shown in FIG. 5. The top plates 180 of the fan assembly 134 may include locking elements, such as prop bars, latches, braces, and so forth, that enable the technician to lock the fan assembly 134 in the folded or lifted position for transportation. Because oversize shipping requirements may not rely on a height of a shipped object for determining an oversize status, the increased height of the fan assembly 134 in the folded or lifted position may not restrict the collapsible RTU 102 from being transported on standard-sized transportation vehicles. In some embodiments, the fan assembly 134 may additionally or alternatively be removable from the collapsible RTU 102, such that the collapsible RTU 102 is shipped without the fan assembly 134 attached to the frame 108. Moreover, although the present embodiment includes one top plate 180 for each condenser 132, it is to be understood that any other suitable number of top plates 180 for any suitable number and shape of condenser coils may be used.

As illustrated, the compressors 136 are disposed in the edge portions 174 of the frame 108, such that the compressors 136 are located between the condensers 132 and the wall portions 166 of the frame 108. In the illustrated embodiment, two compressors 136 are disposed on one edge portion 174, while two additional compressors 136 are disposed on a second edge portion 174, opposite the condensers 132. In the present embodiment, the collapsible RTU 102 includes two refrigeration circuits, such that each set of two compressors 136 may be utilized for a separate refrigeration circuit. By positioning the compressors 136 in the edge portions 174, the inner condenser coils 170 of the condensers 132 can be moved upward to provide a space between the inner condenser coils 170, in contrast to traditional compressor placement that may be between the condensers 132 and may therefore block the space between the inner condenser coils 170. The compressors 136 may alternatively be located in any suitable position that does not interfere with collapsibility of the collapsible RTU 102.

Moreover, the illustrated blower 140 is positioned within a center portion 194 of the frame 108, such that lateral spaces 196 are defined between the blower 140 and the frame 108. As such, the frame 108 may be collapsed, thereby reducing a size of the lateral spaces 196 adjacent to the blower 140 along the y-axis 114 without interfering with the blower 140. In such embodiments, a floor panel 200 below the blower 140 may include multiple parts or components, such as a center portion on which the blower 140 is disposed and two outer portions that flank the center portion on opposite sides. When the collapsible RTU 102 is transitioned from the expanded position to the collapsed position, the two outer portions may slide underneath or above the center portion during collapsing of the frame 108. In some embodiments, the blower 140 may be transported to the building 10 separate from the collapsible RTU 102 and installed within the collapsible RTU 102 at or near the building 10.

Further, the evaporator assembly 142 or evaporator of the present embodiment includes two evaporator coils 144 that are longitudinally offset along the x-axis 116 from one another. That is, one evaporator coil 144 may be positioned closer to the blower 140 than a second evaporator coil 144 by a distance along the x-axis 116 that is a same magnitude or greater than a coil thickness 202 of the one evaporator coil 144. As such, when the frame 108 is moved to the collapsed position, the evaporator coils 144 overlap with one another relative to the x-axis 116. That is, each evaporator coil 114 may move along the y-axis 114 into a respective space 204 adjacent to each evaporator coil 144 without interference. In other words, a back surface 206 of one evaporator coil 144 may slide in front of a front surface 208 of the other evaporator coil 144. In the present embodiment, the evaporator coils 144 are coupled within separate refrigeration circuits, such that the evaporator coils 144 are fluidly separate and are not directly coupled to one another. Due to the fluid independence of each evaporator coil 144, overlapping or sliding of the evaporator coils 144 past one another during collapsing of the frame 108 may be simplified compared to embodiments in which the evaporator coils 144 are part of a shared or common refrigeration circuit.

However, in embodiments in which the evaporator coils 144 are part of a shared or common refrigeration circuit, fluid connections between the two coils may be installed after the collapsible RTU 102 is transported to the building 10. Alternatively, the connections may include conduits of an increased length that enable the evaporator coils 144 to move relative to one another without interfering with the conduits and/or the connections may include flexible piping that adjusts in length and/or positioning based on a position of the frame 108. Moreover, in some embodiments, the compressors 136 and the evaporator coil 144 of a common refrigeration circuit may be disposed on a common edge portion 174 of the frame 108. As such, during collapsing of the frame 108, the compressors 136 and the evaporator coil 144 of the common refrigeration circuit may move along the y-axis 114 together, reducing or eliminating relative motion between the evaporator coil 144 and the compressors 136. In such embodiments, a fluid connection between the evaporator coil 144 and the compressors 136 may be formed by the rigid tubing 154. In some embodiments, the rigid tubing 154 is formed of metal or another inflexible material that may have a reduced cost and/or increased durability compared to the flexible tubing 152.

Similar to the evaporator assembly 142, the air filter assembly 146 includes two filter elements 150 that are offset along the x-axis 116 by a filter width 210 of a filter element 150 or by a greater dimension. The filter elements 150 may each extend across the longitudinal centerline 176 of the collapsible RTU 102 to overlap with one another and reduce or eliminate a gap between the filter elements 150 that may otherwise enable air to bypass the air filter assembly 146 during operation of the collapsible RTU 102. As such, during collapsing of the collapsible RTU 102, the filter elements 150 slide past one another to an overlapped position having a reduced width extending along the y-axis 114 to enable cost-efficient transport of the collapsible RTU 102.

Figure 6:
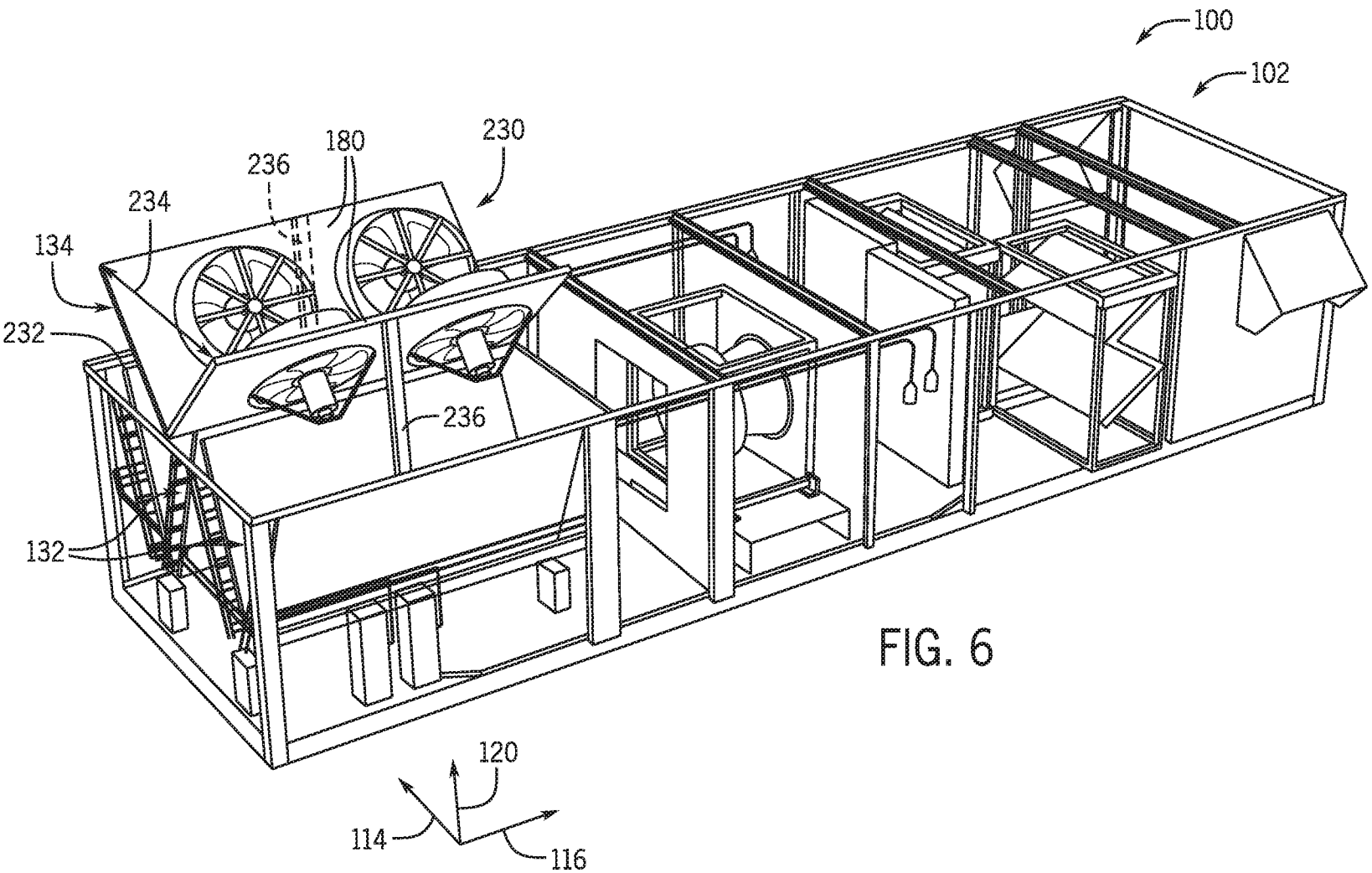
FIG. 6 is a perspective cutaway view of an embodiment of the collapsible RTU of FIG. 5 illustrating a fan assembly in a lifted position, in accordance with an aspect of the present disclosure.

FIG. 6 is a perspective cutaway view of an embodiment of the collapsible RTU 102 of the collapsible RTU system 100, illustrating the fan assembly 134 in a lifted position 230. That is, the top plates 180 of the fan assembly 134 are rotated upward from the horizontal position, such that the outer edge portions 186 of the top plates 180 are separated from top edges 232 of the frame 108. As such, a lifted fan assembly width 234 defined along the y-axis 114 is less than the expanded width 110 of the frame 108 illustrated in FIG. 5. Additionally, the fan assembly 134 may be held in the lifted position 230 by braces 236 that may be positioned between the frame 108 and the outer edge portions 186 of the top plates 180 by a technician. However, any other suitable locking or holding device, such as a cable or chain binding the outer edge portions 186 of the top plates 180 together, may be used in addition or in alternative to the braces 236. In some embodiments, lifting the fan assembly 134 first before collapsing the condensers 132 provides more space for collapsing the condensers 132, though any other suitable order may be followed to collapse the collapsible RTU 102.

Figure 7:
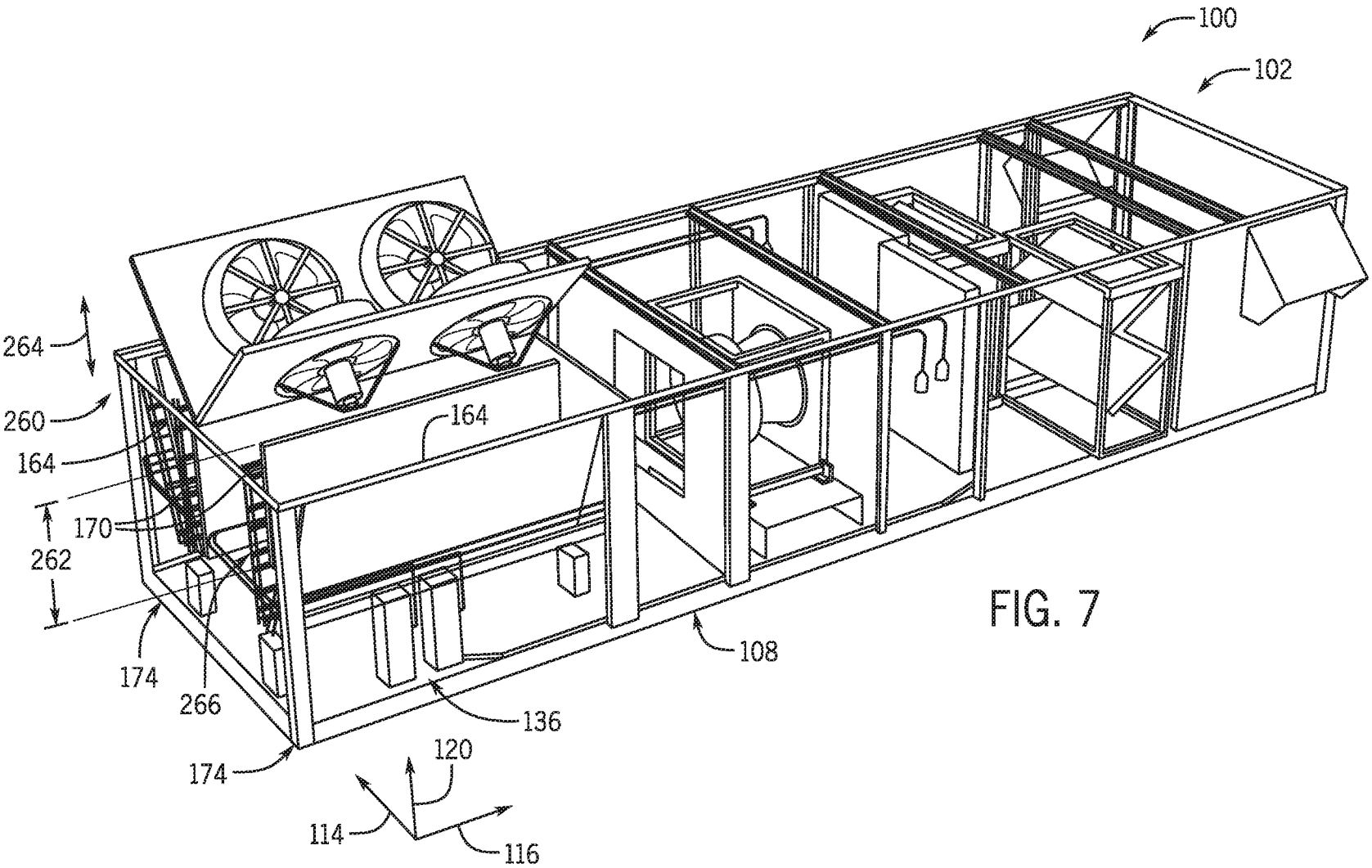
FIG. 7 is a perspective cutaway view of an embodiment of the collapsible RTU of FIG. 5 illustrating inner condenser coils rotated to a vertical position, in accordance with an aspect of the present disclosure.

FIG. 7 is a perspective cutaway view of an embodiment of the collapsible RTU 102, illustrating the inner condenser coils 170 rotated to a generally vertical position 260 or vertical transportation position. When in the generally vertical position 260, a dimension 262 or coil height of the inner condenser coils 170 may generally extend vertically along the z-axis 120, such as in a common direction 264 with the frame height 122 of the frame 108 of the collapsible RTU 102. As such, a space 266 extending along the y-axis 114 between the inner condenser coils 170 is made available for width reduction of the frame 108 of the collapsible RTU 102. In some embodiments, the inner condenser coils 170 may be rotated to the generally vertical position 260 again after installation of the collapsible RTU 102 on the building 10 to provide the space 266 for more efficient cleaning, servicing, and/or inspection of certain components of the collapsible RTU 102. The inner condenser coils 170 may be locked into the vertical position 260 by ties, locking mechanisms, magnets, braces, or any other suitable reversible locking device.

Moreover, in other embodiments, such as those in which the compressors 136 are located in an alternative position other than between the condensers 132 and the edge portions 174 of the frame 108, the outer condenser coils 164 may also be rotatable to generally vertical positions to provide additional or alternative space within the frame 108 for collapsing of the RTU. Additionally, in embodiments having a first condenser, a second condenser, and a third condenser arranged side by side by side, the first condenser and the third condenser may include inner condenser coils that pivot in the manner described above, while both condenser coils of the second condenser may pivot to respective vertical positions. As such, two spaces may be defined within the condenser section, a first space between the first condenser and the second condenser, and a second space between the second condenser and the third condenser.

Figure 8:
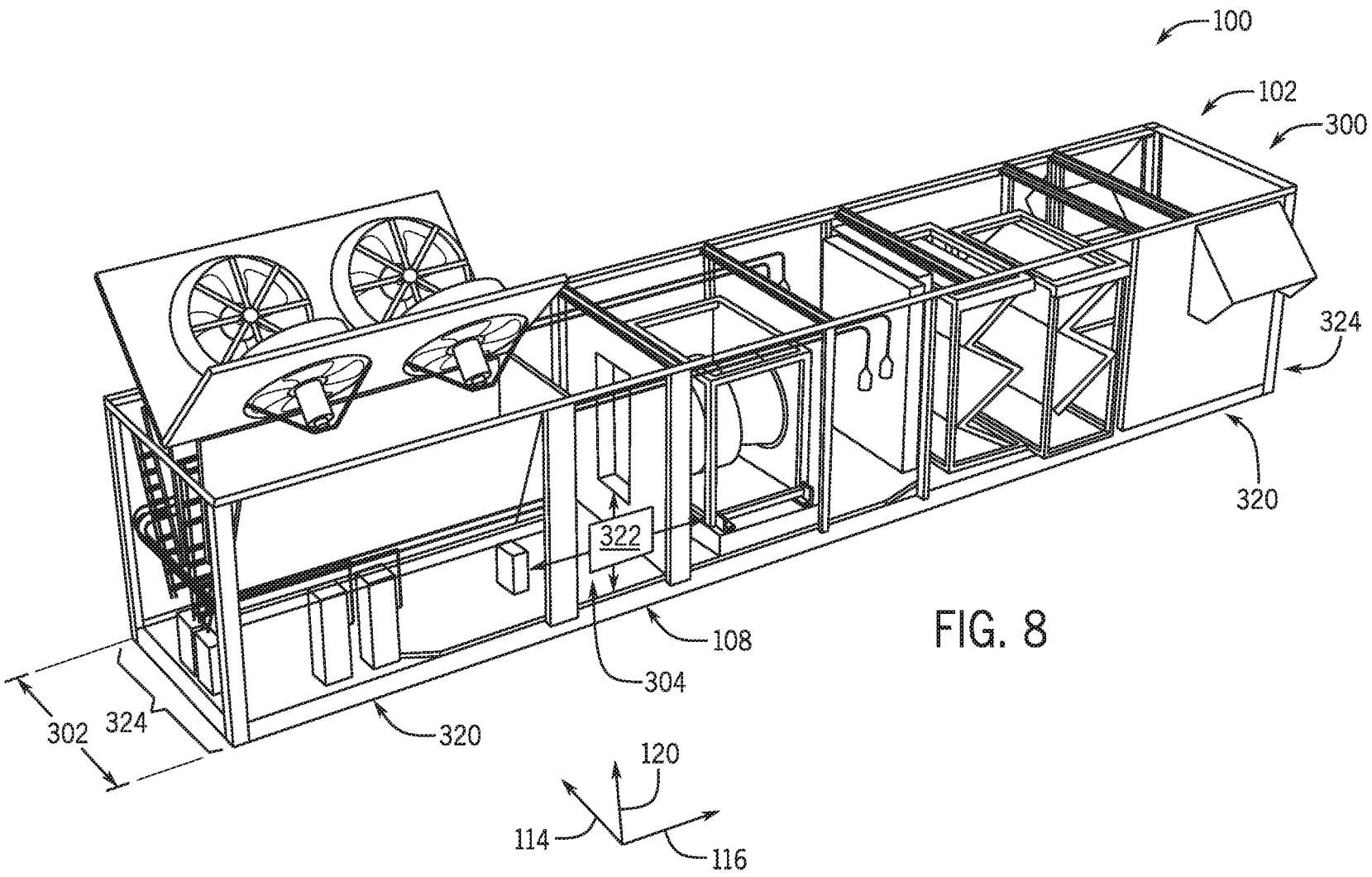
FIG. 8 is a perspective cutaway view of an embodiment of the collapsible RTU of FIG. 5 in a folded or collapsed position, in accordance with an aspect of the present disclosure.

FIG. 8 is a perspective cutaway view of an embodiment of the collapsible RTU 102 of the collapsible RTU system 100 in a collapsed position 300. As previously described with reference to FIG. 5, the frame 108 may include telescoping beams or support elements that are moveable to adjust the expanded width 110 of the frame 108 in FIG. 5 to be a collapsed width 302 or reduced frame width that enables the collapsible RTU 102 to be shipped on a standard-sized transportation vehicle. Further, floor panels 304 of the collapsible RTU 102 may be disposed on various tracks or include various sliding elements, such that collapsing of the frame 108 does not interfere with the HVAC components 106 disposed within the frame 108.

Further, the frame 108 may be collapsed passively or actively. In some embodiments, wheels are included on a bottom surface 320 of the frame 108 extending along a plane between the x-axis 116 and the y-axis 114 to enable the collapsible RTU 102 to be more easily manipulated. For example, a motor may be coupled to the frame 108 to selectively contract the frame 108, such as based on selection of user-selectable interface and/or application of power to the motor. Additionally, users and/or devices may apply compressive force to outer surfaces 322 of the frame 108 extending along the x-axis 116 and/or the z-axis 120 to contract or collapse the frame 108 to have the collapsed width 302. As described below, passive collapsing may be achieved by placing wedges below the wheels along short edges 324 of the frame 108 extending along the y-axis 114, such that a weight of the collapsible RTU 102 causes each wheel to move downward along a selectively-shaped or contoured sloped surface that drives the frame 108 into the expanded position 104 or the collapsed position 300. Once moved into the desired position, the frame 108 may be locked in place with any suitable fastener or locking device.

Generally, by moving the collapsible RTU 102 from the expanded position 104 of FIG. 5 having the expanded width 110 to the collapsed position 300 having the collapsed width 302, the collapsible RTU 102 can be selectively and reversibly resized to correspond to a width of a standard-sized transportation vehicle or another suitable reduced width. Looking to examples of dimensions of embodiments of the collapsible RTU 102, the collapsible RTU 102 may include the expanded width 110 of approximately 92 inches (2.34 m) that may be contracted by approximately 37% to the collapsed width 302 of approximately 58 inches (1.47 m). In some embodiments, the expanded width 110 may be approximately 140 inches (3.56 m) and the collapsible RTU 102 may be contracted to the collapsed width 302 of approximately 96 inches (2.44 m) for an approximately 31% width reduction, thus enabling the collapsible RTU 102 to be transported on standard-sized transportation vehicles having a 96 inch width restriction. As such, the embodied collapsible RTU system 100 enables the collapsible RTU 102 to be reduced in width by 20%, 30%, 40%, 50%, or more.

Figure 9:
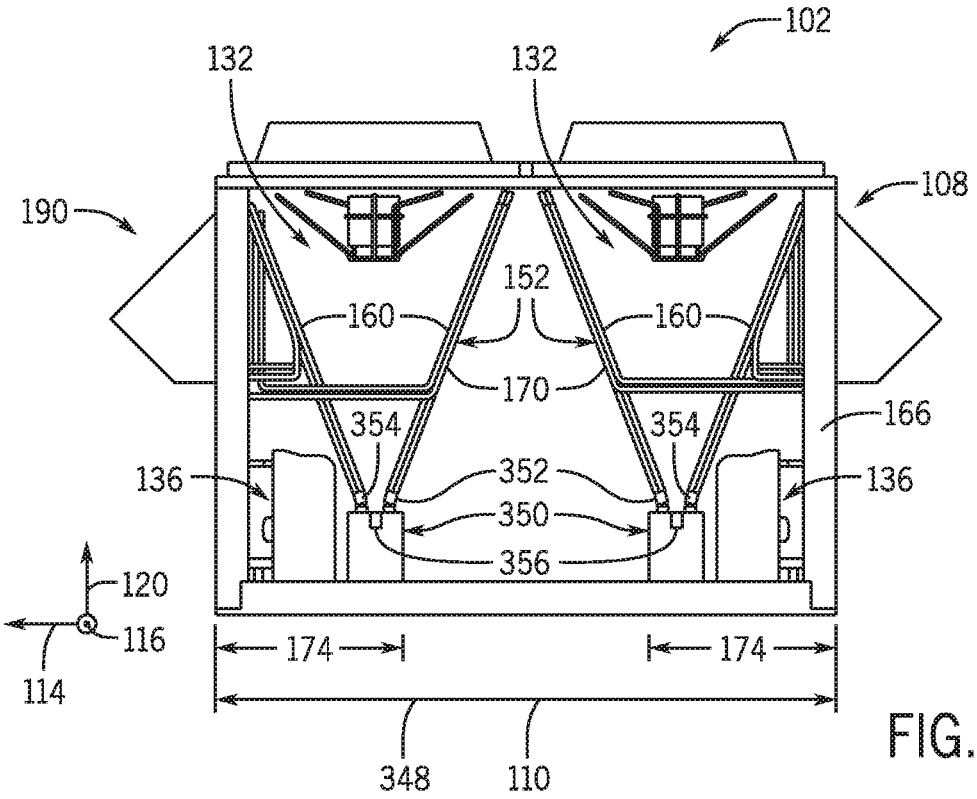
FIG. 9 is a side view of an embodiment of the collapsible RTU of FIG. 5, in accordance with an aspect of the present disclosure.

FIG. 9 is a side view of an embodiment of the collapsible RTU 102 in the expanded position 104 viewed along the x-axis 116. That is, the frame 108 has the expanded width 110, the condensers 132 of the condenser section 130 are in the operating position 172, and the fan assembly 134 is in the horizontal position 190. Because the condenser section 130 may have a same width as the frame 108, the expanded width 110 of the frame also corresponds to a full condenser section width 348. As previously described, the condenser coils 160 are oriented such that their condenser coil length 162 extends along the x-axis 116. Additionally, the compressors 136 are disposed in the edge portions 174 of the condenser section 130, between the condensers 132 and the wall portions 166 of the frame 108. As shown, the fans 184 of the fan assembly 134 are disposed over the condensers 132 to draw air through the condensers 132 during operation of the collapsible RTU 102 at the building 10.

Additionally, for each condenser 132, the two condenser coils 160 are coupled to a base portion 350. For the illustrated embodiment, pivot points 352 or joints are disposed between the inner condenser coils 170 and the base portions 350. The pivot points 352 may be any suitable pivotable or rotatable connection between each inner condenser coil 170 and its respective base portion 350. For example, the pivot points 352 may be a hinge that extends along the condenser coil length 162 of the inner condenser coils 170 of FIG. 5. Outer connections 354 between the base portions 350 and the outer condenser coils 164 may also be pivotable or rotatable, in certain embodiments. By positioning the pivot points 352 a separation distance 356 from the outer connections 354, interference between the adjacent condenser coils 160 and/or the flexible tubing 152 connected thereto may be reduced or eliminated during rotation of the inner condenser coils 170 toward the outer condenser coils 164.

Figure 10:
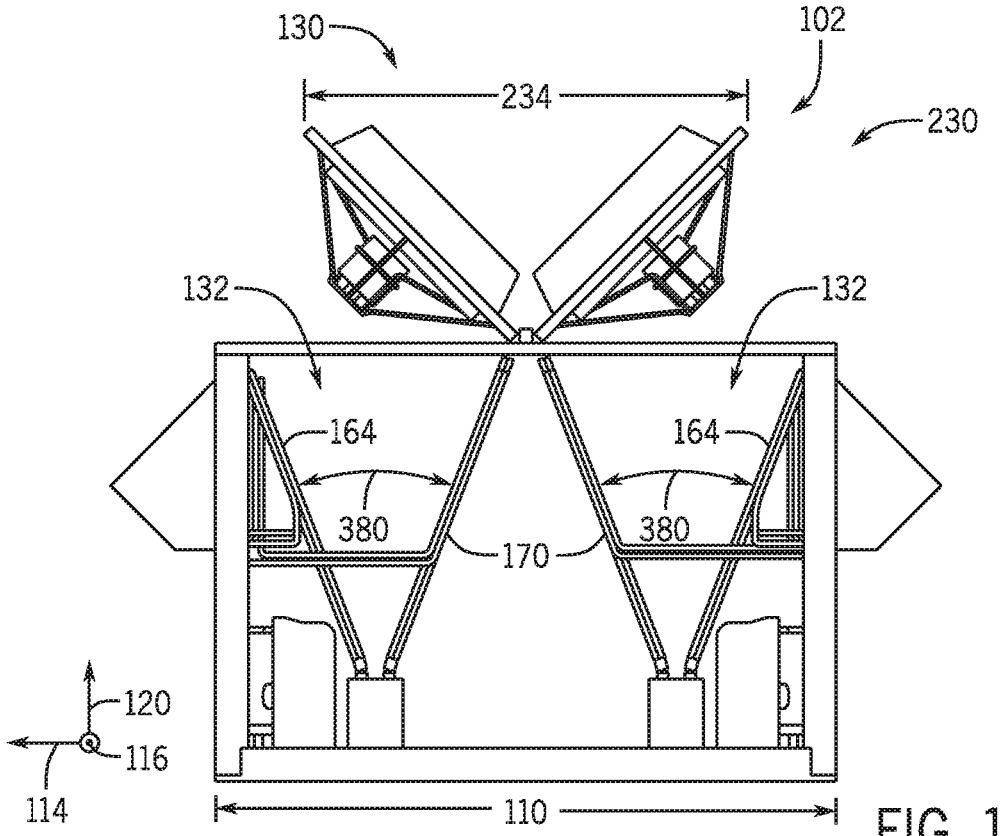
FIG. 10 is a side view of an embodiment of the collapsible RTU of FIG. 6, in accordance with an aspect of the present disclosure.

FIG. 10 is a side view of an embodiment of the collapsible RTU 102, illustrating the fan assembly 134 in the lifted position 230. As discussed with reference to FIG. 6, in the lifted position 230, the fan assembly 134 has the lifted fan assembly width 234 that is less than the expanded width 110 of the frame 108. Additionally, for each condenser 132 in the illustrated V-shaped configuration, the outer condenser coils 164 and the inner condenser coils 170 are disposed at an operating angle 380 relative to one another. In the present embodiment, the operating angle 380 is approximately 42 degrees, although any other suitable angle may be maintained by the condensers 132 of the collapsible RTU 102.

Figure 11:
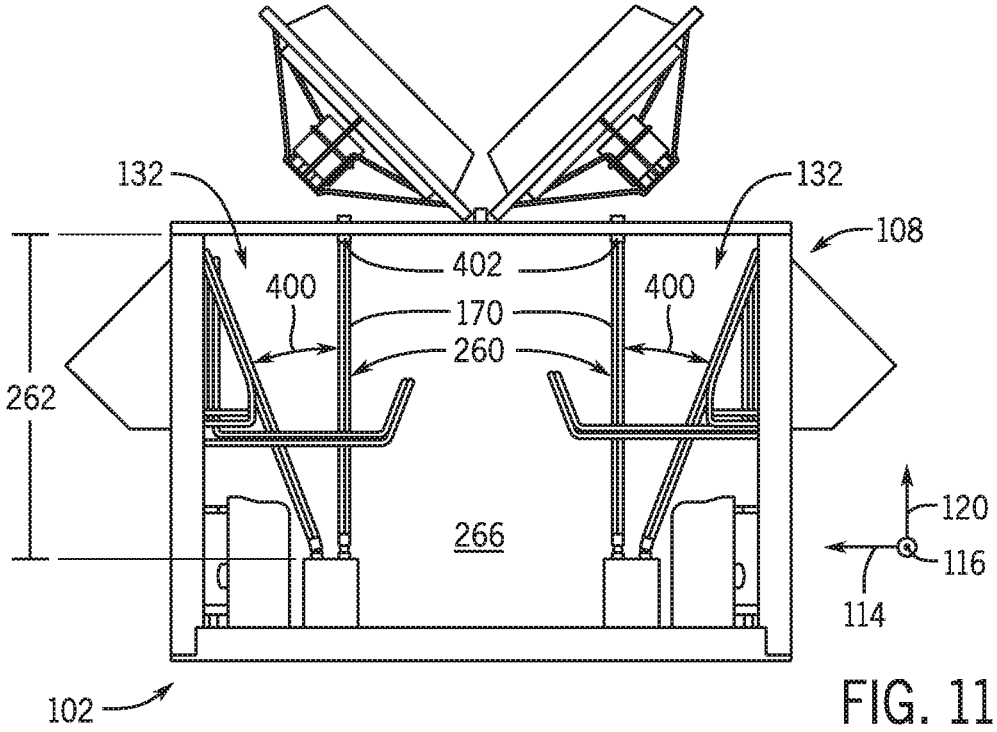
FIG. 11 is a side view of an embodiment of the collapsible RTU of FIG. 7, in accordance with an aspect of the present disclosure.

FIG. 11 is a side view of an embodiment of the collapsible RTU 102, illustrating the inner condenser coils 170 rotated to the vertical position 260. As discussed above with reference to FIG. 7, the dimension 262 or coil height of each inner condenser coil 170 in the vertical position 260 extends vertically along the z-axis 120, creating the space 266 between the inner condenser coils 170. Therefore, the outer condenser coils 164 and the inner condenser coils 170 are disposed at a collapsed angle 400 relative to one another. The collapsed angle 400 may be generally half of the operating angle 380, such as approximately 21 degrees, or any other suitable angle that is less than the operating angle 380 of the condenser coils 160. The inner condenser coils 170 may be locked into the vertical position 260 by fasteners 402, such as ties, locking mechanisms, magnets, braces, or any other suitable reversible locking device.

Figure 12:
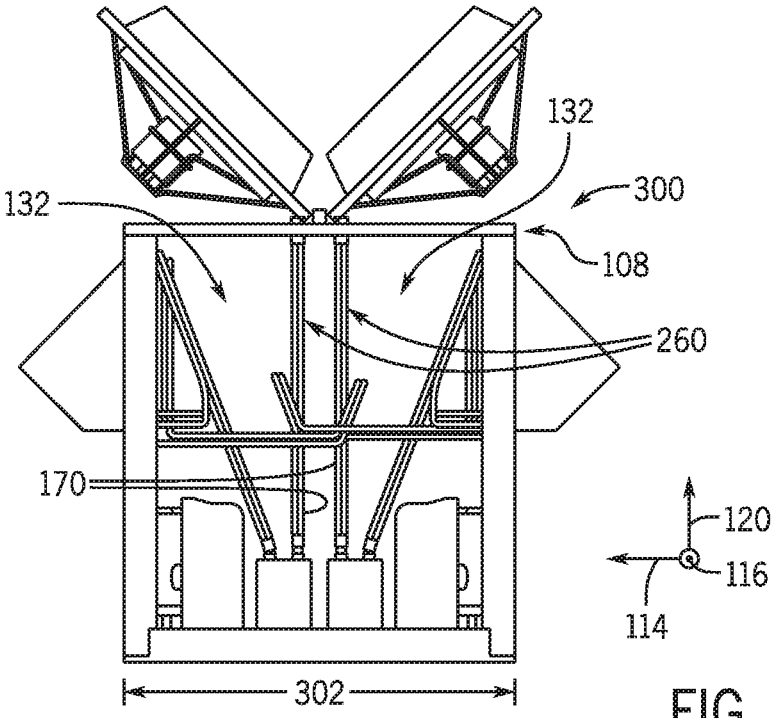
FIG. 12 is a side view of an embodiment of the collapsible RTU of FIG. 8, in accordance with an aspect of the present disclosure.

FIG. 12 is a side view of an embodiment of the collapsible RTU 102 in the collapsed position 300. As discussed above with reference to FIG. 8, the collapsible RTU 102 therefore includes the collapsed width 302 or reduced condenser section width, which is less than the expanded width 110 of the collapsible RTU 102 to enable transportation via standard-sized transportation vehicles. In particular, the frame 108 is collapsed along the y-axis 114 such that the condensers 132 having the inner condenser coils 170 in the vertical positions 260 are moved closer together. Because the condensers 132 are moved into the previously-available space 266 defined therebetween, collapsing of the frame 108 may not cause physical interference between the condensers 132.

Figures 13, 14:
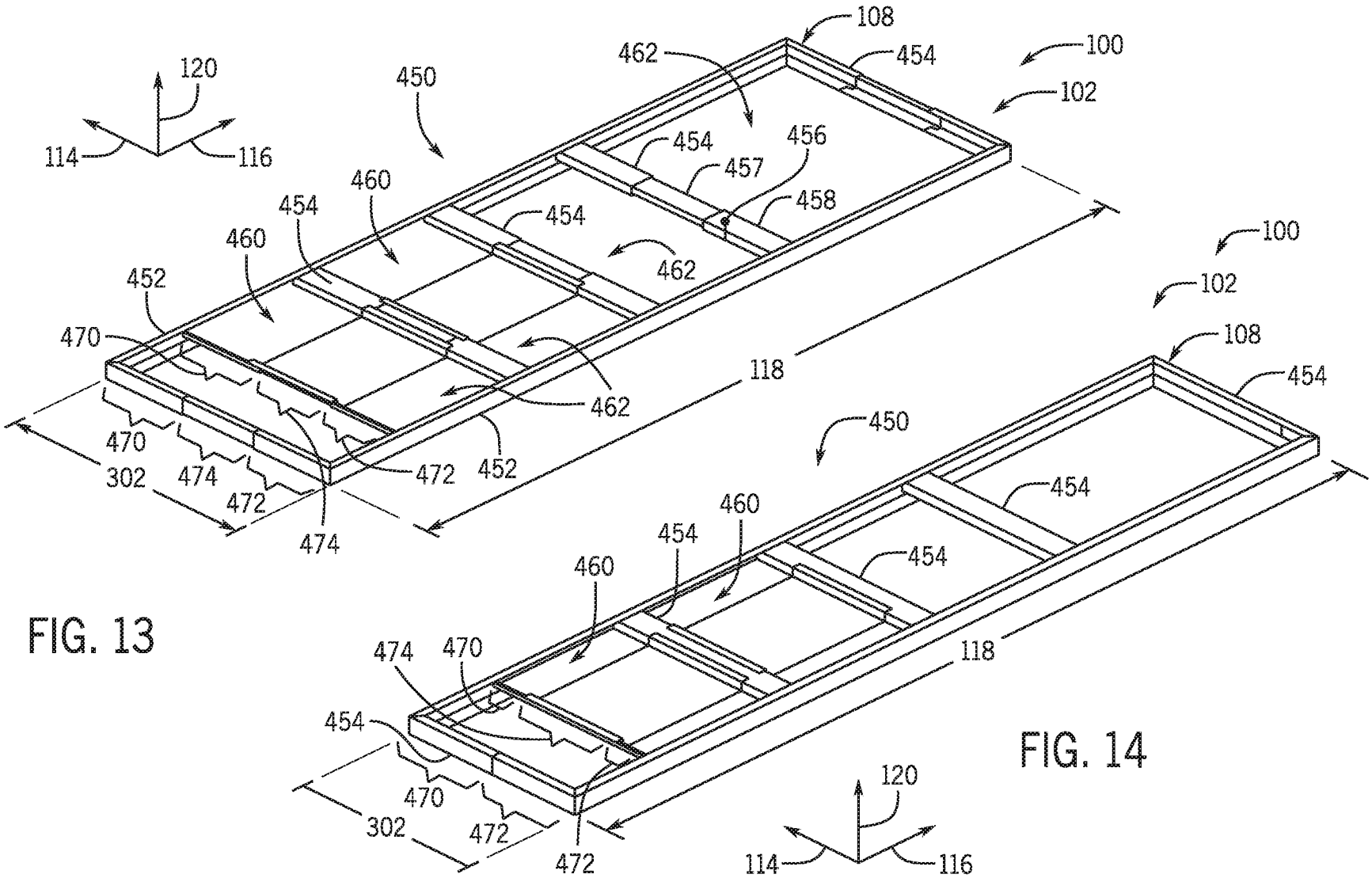
FIG. 13 is a perspective view of an embodiment of a base rail assembly of the collapsible RTU system of FIG. 5, in accordance with an aspect of the present disclosure.
FIG. 14 is a perspective view of an embodiment of the base rail assembly of FIG. 13, in accordance with an aspect of the present disclosure.

FIG. 13 is a perspective view of an embodiment of a base rail assembly 450 for the collapsible RTU 102 of the collapsible RTU system 100. The base rail assembly 450 may be a portion or bottom supporting surface of the frame 108, in some embodiments. As illustrated, the base rail assembly 450 is a rectangular assembly having fixed side rails 452 that each extend along the frame length 118 of the frame 108 and telescopic cross rails 454, retractable rails, or extendable rails that extend between the fixed side rails 452. The telescopic cross rails 454 are selectively sizeable to enable the frame 108 to move between the expanded width 110 and the collapsed width 302. In some embodiments, the telescopic cross rails 454 may be locked or retained in a desired position by a fastener 456 or a plurality of fasteners disposed through corresponding openings in an inner rail 457 and an outer rail 458 of the frame.

The base rail assembly 450 may also include drain pans 460 received within cells 462 defined between the fixed side rails 452 and the telescopic cross rails 454. As such, the drain pans 460 may be disposed underneath the condenser section 130 and/or the evaporator assembly 142 to collect condensate therefrom. As illustrated, the telescopic cross rails 454 and the drain pans 460 each include a three piece construction extending along the y-axis 114, including a first edge portion 470, a second edge portion 472, and a central portion 474 disposed between the edge portions 470, 472. Thus, during collapsing of the frame 108, the edge portions 470, 472 move closer together to reduce the expanded width 110 of the frame 108.

FIG. 14 is a perspective view of an embodiment of the base rail assembly 450, illustrating the collapsed width 302. That is, the inner rails 457 of the telescopic cross rails 454 are slid within the outer rails 458 of the telescopic cross rails 454. Additionally, the central portions 474 of the drain pans 460 have remained stationary, while the edge portions 470, 474 of the drain pans 460 are positioned at least partially underneath the central portion 474. However, any other suitable folding or telescoping assembly for reducing a width of the base rail assembly 450 may also be employed using the techniques described herein.

Figure 15:
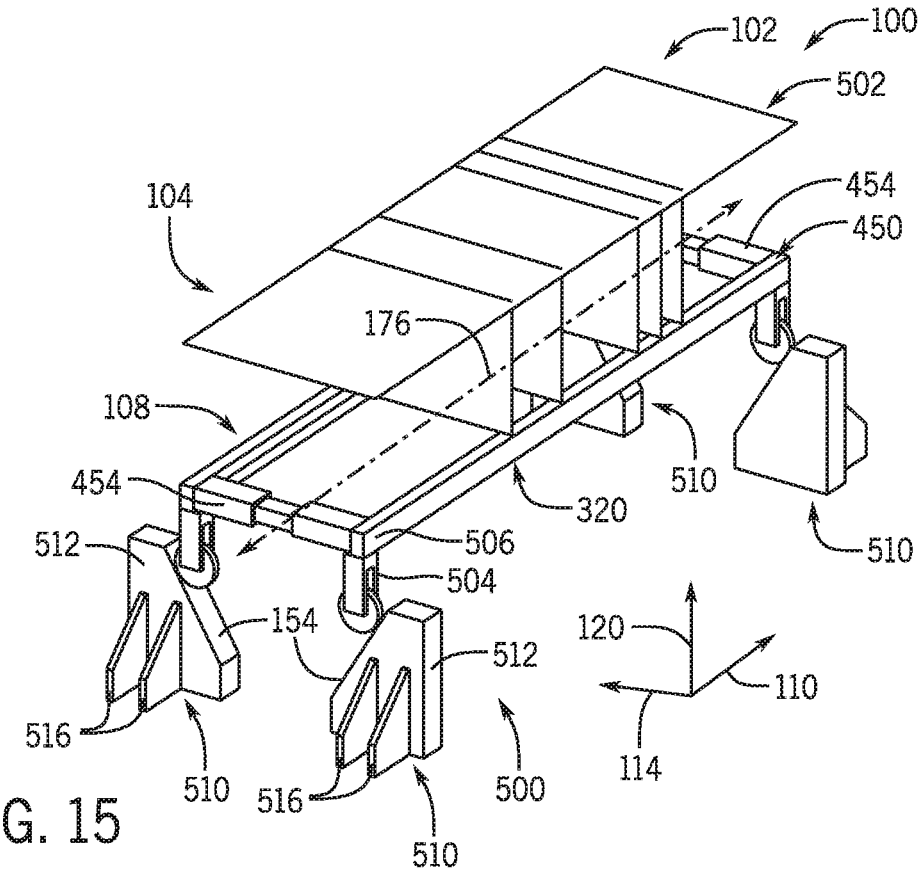
FIG. 15 is a perspective view of an embodiment of a folding or collapsing assembly of the collapsible RTU system of FIG. 5, in accordance with an aspect of the present disclosure.

FIG. 15 is a perspective view of an embodiment of a collapsing assembly 500 of the collapsible RTU system 100, illustrating the collapsible RTU 102 in the expanded position 104. Although only a portion of the collapsible RTU 102 including a portion of the base rail assembly 450 and certain panels 502 for the collapsible RTU 102 are illustrated, it is to be understood that any suitable portion of the collapsible RTU 102 or the entire collapsible RTU 102 may be manipulated in width via the collapsing assembly 500 disclosed herein. As illustrated, to efficiently use the collapsing assembly 500, the collapsible RTU 102 includes wheels 504 coupled to corners 506 of the bottom surface 320 of the frame 108.

Moreover, the collapsing assembly 500 includes a collapsing wedge 510 for each wheel 504 of the collapsible RTU 102. In some embodiments, the collapsible RTU 102 is lifted onto the collapsing wedges 510 by a crane or another suitable lifting process. Each collapsing wedge 510 includes a main portion 512 having an inwardly-sloped surface 514, as well as base fins 516 that extend from and support the main portion 512. As referred to herein, the inwardly-sloped surfaces 514 are sloped inward relative to the longitudinal centerline 176 of the collapsible RTU 102, such that the inwardly-sloped surface 514 of two adjacent collapsing wedges 510 face one another. The collapsing wedges 510 of the collapsing assembly 500 may be of any suitable shape with inwardly-sloped surfaces, including main portions 512 with a greater width that reduces or eliminates a dependence on the base fins 516, or collapsing wedges 510 that include removable base fins 516.

Accordingly, a weight of the collapsible RTU 102 may drive the wheels 504 along the inwardly-sloped surfaces 514 to drive the telescopic cross rails 454 of the base rail assembly 450 together towards a collapsed or overlapping position. In this manner, the collapsible RTU 102 may be passively compressed to the collapsed width 302 by the collapsing assembly 500. Additionally, the collapsing assembly 500 may be reused to collapse the collapsible RTU 102 multiple times.

Figure 16:
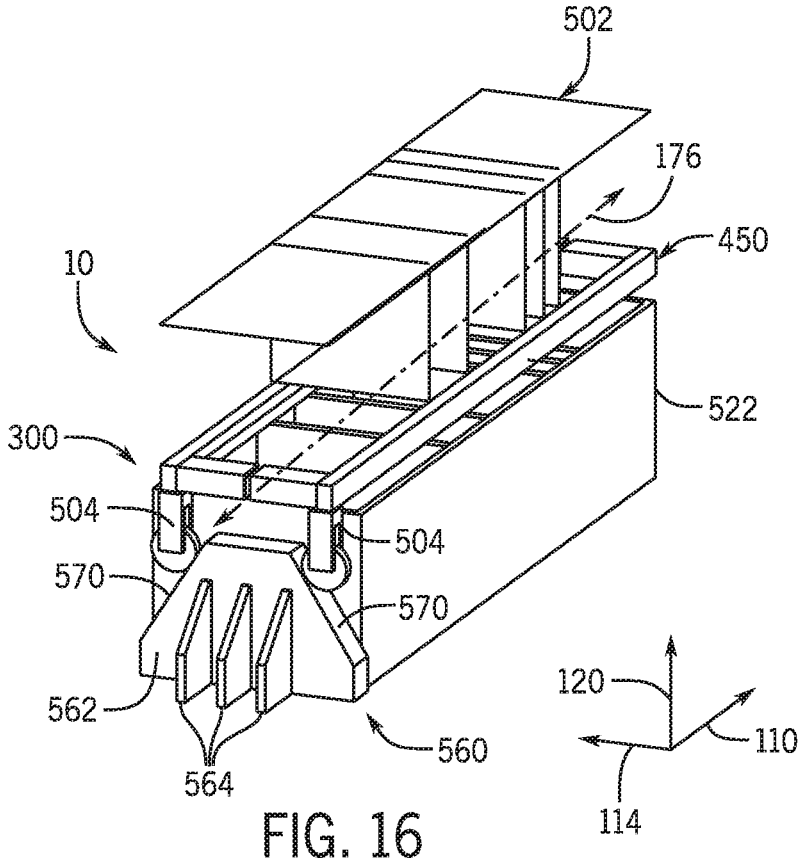
FIG. 16 is a perspective view of an embodiment of an unfolding or expanding assembly of the collapsible RTU system of FIG. 5, in accordance with an aspect of the present disclosure.

FIG. 16 is a perspective view of an embodiment of an expanding assembly 550 of the collapsible RTU system 100 having the collapsible RTU 102 in the expanded position 300. In some embodiments, the expanding assembly 550 is employed to reverse a collapsing process performed with the collapsing assembly 500 of FIG. 15 and may be utilized to expand the collapsible RTU 102 on top of a curb 552 at the building 10 where the collapsible RTU 102 is to be installed. The expanding assembly 550 includes two expanding wedges 560: one underneath each pair of the wheels 504 of the collapsible RTU 102. Each expanding wedge 560 includes a main portion 562 and base fins 564 for supporting the main portion 562 of each expanding wedge 560. The main portion 562 may include two outwardly-sloped surfaces 570 that are sloped outwardly relative to the longitudinal centerline 176 of the collapsible RTU 102. As such, by lifting the collapsible RTU 102 onto the expanding wedges 560, the weight of the collapsible RTU 102 may drive the wheels 504 and the base rail assembly 450 coupled thereto apart, such that the collapsible RTU 102 is expanded into the expanded position 104.

In some embodiments, the outwardly-sloped surfaces 570 may be mirror images, or reflections across a plane generally extending along the z-axis 120 and the x-axis 114, of the inwardly-sloped surfaces 514 of the collapsing wedges 510 of the collapsing assembly 500. In other words, the respective slopes of the outwardly-sloped surfaces 570 and the inwardly-sloped surfaces 514, relative to a horizontal plane or surface such as the roof of the building 10, may be similar or identical. Moreover, in some embodiments, the expanding wedge 560 may be formed from two of the collapsing wedges 510, such as by disposing non-sloped surfaces of the main portions 512 together and repositioning the base fins 516 to be on an opposed side of the main portions 512.

Figure 17:
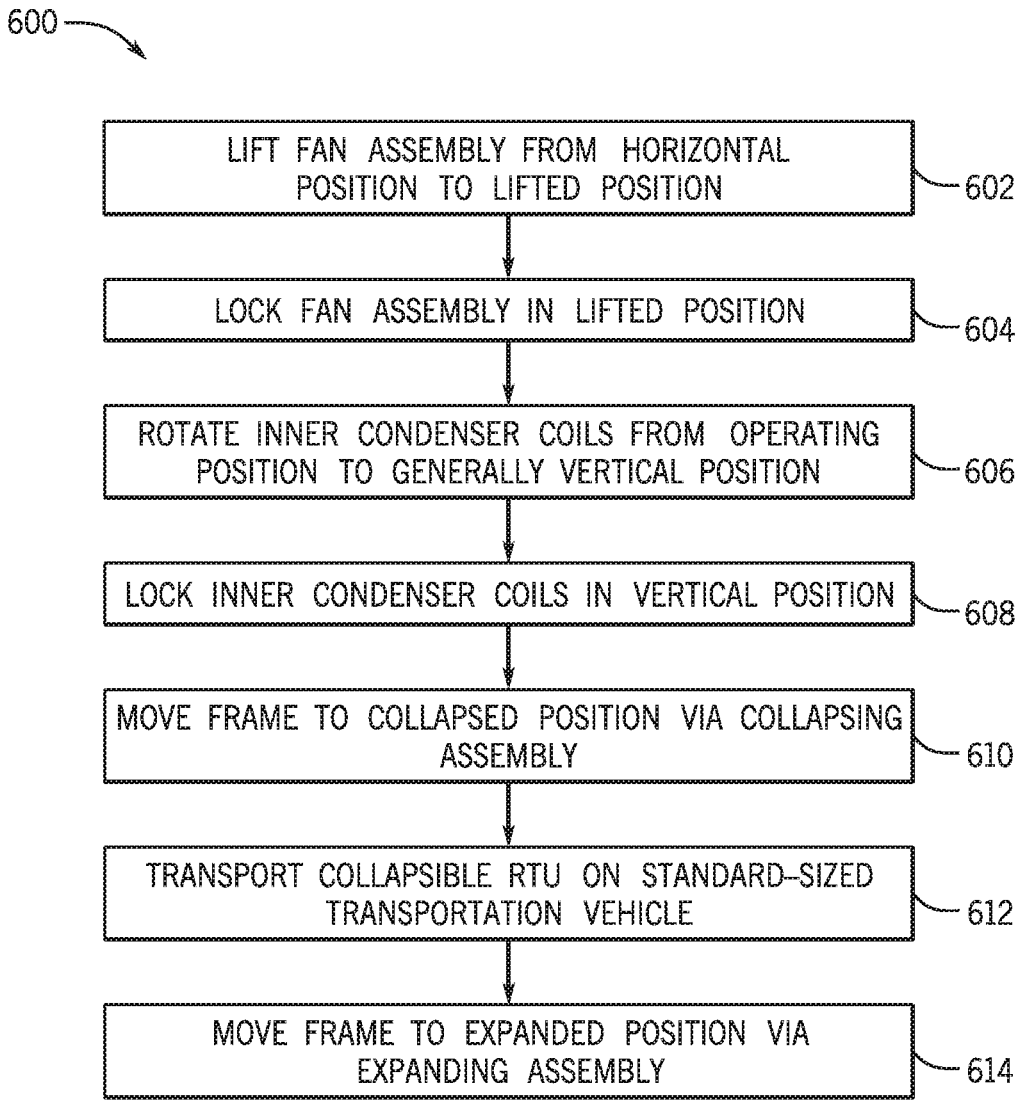
FIG. 17 is a flow diagram of an embodiment of a process of operating the collapsible RTU system of FIG. 5, in accordance with an aspect of the present disclosure.

FIG. 17 is a flow diagram of an embodiment of a process 600 that may be performed by a technician and/or machine to operate the collapsible RTU system 100 to collapse and transport the collapsible RTU 102. It is to be understood that the steps discussed herein are merely exemplary, and certain steps may be omitted or performed in a different order than the order discussed herein. Although the process 600 is discussed with reference to the collapsible RTU 102 having the particular HVAC components 106 and the frame 108 described above, the process 600 may be performed with any other suitable collapsible RTU having any suitable components.

As indicated at block 602, the process 600 may include lifting the fan assembly 134 from the horizontal position 190 to the lifted position 230. As such, the fan assembly 134 reduces in width and increases in height. Next, as indicated at block 604, the process 600 may include locking the fan assembly 134 in the lifted position 230. For example, as discussed above with reference to FIG. 6, braces 236 or other suitable fasteners may be disposed underneath the lifted fan assembly 134 to maintain the fan assembly 134 in the lifted position 230.

As indicated at block 606, the process 600 may also include rotating the inner condenser coils 170 from the operating position 172 to the generally vertical position 260. Then, the process 600 may include locking the inner condenser coils 170 in the generally vertical position 260, as indicated at block 608. Thus, as discussed above with reference to FIG. 7, the space 266 may be created between the condensers 132 of the condenser section 130.

In some embodiments, the process 600 may include moving the frame 108 from the expanded position 104 to the collapsed position 300 via the collapsing assembly 500, as indicated at block 610. Indeed, as illustrated in FIG. 15, the collapsing assembly 500 may include the collapsing wedges 510 having the inwardly-sloped surfaces 514, such that the collapsible RTU 102 may be lifted onto the collapsing wedges 510 to enable the wheels 504 to travel down the inwardly-sloped surfaces 514 and drive the telescoping cross rails 454 together. In some embodiments, the frame 108 may be locked in the collapsed position 300 by the fastener 456 disposed through inner rails 457 and outer rails 458 of the telescoping cross rails 454. As indicated at block 612, the process 600 may include transporting the collapsible RTU 102 now having the collapsed width 302 on a standard-sized transportation vehicle. Thus, the collapsible RTU 102 may be transported with increased efficiency, increased speed, and reduced cost compared to traditional RTUs that may be classified as oversized loads.

Once delivered to a desired location, the process 600 may include moving the frame 108 to the expanded position 104 via the expanding assembly 550, as indicated at block 614. That is, as discussed with reference to FIG. 16, the collapsible RTU 102 may be lifted on top of the expanding wedges 560 to utilize the weight of the collapsible RTU 102 to drive the telescoping cross rails 454 apart. Thus, the collapsible RTU 102 may have the expanded width 110 that enables operation of the HVAC components 106 to condition the building. Additionally, the frame 108 may be locked in the expanded position in some embodiments. Moreover, the inner condenser coils 172 may be unlocked and moved back into their operating position 172, while the fan assembly 134 may be unlocked and lowered into the horizontal position 190 to enable the collapsible RTU 102 to condition the building 10.

Moreover, although discussed with reference to the passive collapsing assembly 500 and the passive expanding assembly 550, it is to be understood that any other suitable collapsing and/or expanding assemblies, including motor-actuation or user-applied force, may be employed by the process 600. In some embodiments, after the collapsible RTU 102 reaches its destination or after the collapsible RTU 102 is in the expanded position 104, casings or panels may be disposed on the frame 108. To reduce assembly time and cost, the casings or panels may be fastener-free, such as a rollable metal sheet attached on each surface, a snap-in panel, and so forth.

Accordingly, the present disclosure is directed to a collapsible RTU system for enabling efficient transportation of a collapsible RTU. The collapsible RTU may be selectively reduced in width to fit on standard-sized transportation vehicles during shipping and selectively increased in width to enable standard-sized HVAC components to fit and operate within the collapsible RTU. For example, the collapsible RTU may include a fan assembly that lifts upward to have a greater height and a reduced width, one or more condensers with pivotable condenser coils that rotate into compact positions having a reduced footprint, as well as split evaporator coils that are longitudinally offset relative to a length of the collapsible RTU unit. Thus, the frame disposed around the HVAC components may be collapsed or contracted to reduce a width of the collapsible RTU during transportation, and expanded or deployed at an installation location so that the collapsible RTU may operate to condition the building.

While only certain features and embodiments of the present disclosure have been illustrated and described, many modifications and changes may occur to those skilled in the art, such as variations in sizes, dimensions, structures, shapes and proportions of the various elements, values of parameters, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A collapsible roof top unit (RTU), comprising:

a plurality of heating, ventilation, and air conditioning (HVAC) components, wherein the plurality of HVAC components comprises a condenser and an evaporator in fluid communication with the condenser; and a frame disposed about the plurality of HVAC components, wherein the frame is configured to transition between a full frame width configuration and a reduced frame width configuration via a plurality of retractable rails of the frame.

2. The collapsible RTU of claim 1, wherein the plurality of HVAC components comprises a fan assembly, a compressor, a blower, a filter, or a combination thereof.

3. The collapsible RTU of claim 1, wherein the condenser is configured to transition between an operating position and a collapsed position, wherein a portion of the condenser is pivotable relative to the frame.

4. The collapsible RTU of claim 3, wherein the condenser comprises a plurality of condenser coils, wherein each condenser coil of the plurality of condenser coils comprises a coil length extending generally parallel to a frame length of the frame.

5. The collapsible RTU of claim 4, wherein the plurality of condenser coils comprises a first outer condenser coil and a first inner condenser coil oriented together in a first V-shaped configuration, wherein the plurality of condenser coils comprises a second inner condenser coil and a second outer condenser coil oriented together in a second V-shaped configuration, and wherein the first inner condenser coil and the second inner condenser coil are adjacent to one another.

6. The collapsible RTU of claim 5, wherein the first inner condenser coil is configured to rotate toward the first outer condenser coil and the second inner condenser coil is configured to rotate toward the second outer condenser coil to enable the frame to transition to the reduced frame width configuration.

7. The collapsible RTU of claim 6, wherein the condenser comprises a first pivot point disposed between the first inner condenser coil and a first base portion of the first V-shaped configuration, and wherein the condenser comprises a second pivot point disposed between the second outer condenser coil and a second base portion of the second V-shaped configuration of the condenser.

8. The collapsible RTU of claim 1, wherein the plurality of HVAC components comprises a fan assembly coupled to a condenser section comprising the condenser, wherein the fan assembly comprises a hinge, and wherein the fan assembly is configured to rotate about the hinge between a horizontal position and a lifted position.

9. The collapsible RTU of claim 1, wherein the evaporator comprises a first evaporator coil and a second evaporator coil offset from the first evaporator coil along a first direction parallel to a length of the frame, and wherein the first evaporator coil is moveable relative to the second evaporator coil along a second direction crosswise to the length.

10. The collapsible RTU of claim 9, wherein the first evaporator coil is fluidly coupled to a first refrigerant circuit of the collapsible RTU and the second evaporator coil is fluidly coupled to a second refrigerant circuit of the collapsible RTU separate from the first refrigerant circuit.

11. The collapsible RTU of claim 9, wherein a back surface of the first evaporator coil and a front surface of the second evaporator coil overlap with one another relative to the first direction parallel to the length of the frame in the reduced width frame configuration.

12. The collapsible RTU of claim 1, wherein the plurality of HVAC components comprises a filter assembly comprising a first filter component and a second filter component offset from the first filter component along a direction parallel to a length of the frame, wherein the first filter component and the second filter component overlap with one another relative to the direction parallel to the length of the frame in the reduced width frame configuration.

13. The collapsible RTU of claim 1, comprising a drain pan disposed within the frame, wherein the drain pan comprises a first outer panel, a second outer panel, and a central panel disposed between the first outer panel and the second outer panel, and wherein an inner edge of the first outer panel and an inner edge of the second outer panel are configured to translate along the central panel and underneath the central panel during transition from the full frame width configuration to the reduced frame width configuration.

14. The collapsible RTU of claim 1, wherein the reduced frame width configuration comprises a width dimension configured to fit on a standard-sized transportation vehicle.

15. A collapsible roof top unit (RTU), comprising:

a condenser configured to transition between a full condenser width and a reduced condenser width; and a frame disposed about the condenser, wherein the frame is configured to transition between a full frame width and a reduced frame width via a plurality of retractable rails of the frame.

16. The collapsible RTU of claim 15, wherein the condenser comprises a first condenser coil and a second condenser coil, and wherein the second condenser coil is rotatable, relative to the first condenser coil, between an angled operating position and a generally vertical non-operating position.

17. The collapsible RTU of claim 15, wherein the condenser comprises a plurality of condenser coils, wherein each condenser coil of the plurality of condenser coils comprises a coil length extending generally parallel to a frame length of the frame.

18. The collapsible RTU of claim 15, wherein the condenser comprises a first condenser coil and a second condenser coil oriented together in a first V-shaped configuration.

19. The collapsible RTU of claim 18, wherein the first condenser coil is configured to rotate toward the second condenser coil to enable the frame to transition to the reduced frame width.

20. The collapsible RTU of claim 18, comprising an evaporator disposed within the frame and fluidly coupled to the condenser, wherein the evaporator is configured to transition between a full evaporator width and a reduced evaporator width.

21. A collapsible roof top unit (RTU), comprising:

an evaporator configured to transition between a full evaporator width and a reduced evaporator width; and a frame disposed about the evaporator, wherein the frame is configured to transition between a full frame width and a reduced frame width via a plurality of retractable rails of the frame.

22. The collapsible RTU of claim 21, wherein the evaporator comprises a first evaporator coil and a second evaporator coil offset from the first evaporator coil along a first direction parallel to a length of the frame, and wherein the first evaporator coil is moveable relative to the second evaporator coil along a second direction crosswise to the length to enable the frame to transition to the reduced frame width.

23. The collapsible RTU of claim 22, wherein the first evaporator coil is fluidly coupled to a first refrigerant circuit of the collapsible RTU and the second evaporator coil is fluidly coupled to a second refrigerant circuit of the collapsible RTU separate from the first refrigerant circuit.

24. The collapsible RTU of claim 22, wherein a back surface of the first evaporator coil and a front surface of the second evaporator coil overlap with one another relative to the first direction parallel to the length of the frame in the reduced frame width.

25. The collapsible RTU of claim 21, comprising a condenser disposed within the frame and fluidly coupled to the evaporator, wherein the condenser is configured to transition between a full condenser width and a reduced condenser width.

26. The collapsible RTU of claim 21, wherein the frame comprises a plurality of fixed side rails that extends along a length of the frame, and wherein the plurality of retractable rails extends between the plurality of fixed side rails.

* * * * *